US005244408A

United States Patent [19]

Muller et al.

[11] Patent Number: 5,244,408

[45] Date of Patent: Sep. 14, 1993

[54] TERMINAL HOUSING

[75] Inventors: Paul M. Muller, Byram Township, Sussex County, N.J.; Anthony R. Tancreto, Brooklyn, N.Y.

[73] Assignee: AT&T Bell Laboratories, Murray Hill, N.J.

[21] Appl. No.: 887,994

[22] Filed: May 22, 1992

[51] Int. Cl.[5] ..... H01R 13/52

[52] U.S. Cl. ..... 439/460; 439/367

[58] Field of Search ..... 439/465, 467, 460, 369, 439/367, 540; 174/52.1, 52.3, 67, 138 F, 153 G; 220/344

[56] References Cited

U.S. PATENT DOCUMENTS

| | | | |
|---|---|---|---|
| 3,244,802 | 4/1966 | Sturtevant et al. | 174/153 G |
| 3,757,031 | 9/1973 | Izraeli | 174/138 F |
| 4,004,199 | 1/1977 | Pearce et al. | 174/52.3 X |
| 4,424,407 | 1/1984 | Barbic | 439/369 X |
| 4,645,285 | 2/1987 | Cozzens et al. . | |
| 4,717,356 | 1/1988 | Rahrig et al. . | |
| 4,988,311 | 1/1991 | Tanzola . | |

*Primary Examiner*—Eugene F. Desmond

*Attorney, Agent, or Firm*—Lester H. Birnbaum

[57] ABSTRACT

Disclosed is a terminal housing with a wire entry system providing strain relief and a good seal. Two closed cell foam pads are mounted at each wire entrance port. The ports are shaped so that the wire can be inserted from the top of the housing and strain relief is provided where the wire comes to rest.

11 Claims, 2 Drawing Sheets

TERMINAL HOUSING

BACKGROUND OF THE INVENTION

This invention relates to terminals which include means for providing electrical connections to wires entering from the outside of the terminal housing.

Outside plant telecommunications apparatus usually require one or more wires to be brought into a housing and electrically connected to connector blocks or binding posts included in the housing. Since the apparatus is often subject to harsh environments, a good seal is generally required around the area of entry of the wires. In most existing apparatus, the seal is provided by rubber grommets positioned within holes in the sides of the housing. These grommets usually do not provide an ideal seal. Further, the grommets can pop out of the holes during installation of the wires. Also, since the fit between the grommet inner diameter and the wire is not always a close one, the wires have limited strain relief.

A further problem with existing terminals is that, generally, the wires have to be installed by threading them through the inner diameter of the grommets prior to attachment of the wires to the connector blocks or binding posts. This requirement makes installation of the wires fairly slow and tedious.

SUMMARY OF THE INVENTION

The invention is an electrical terminal including a housing within which is mounted means for providing electrical connections to at least one wire. The housing includes a side surface with at least one aperture therethrough extending to a top edge of the side surface. A first flexible pad is mounted within the aperture. A second flexible pad with a slit extending to a top surface of the second pad is mounted adjacent to the first pad so that the slit is capable of receiving a wire therein inserted from the top surfaces of the pads.

BRIEF DESCRIPTION OF THE DRAWING

These and other features of the invention are delineated in detail in the following description. In the drawing.

It will be appreciated that, for purposes of illustration, these figures are not necessarily drawn to scale.

DETAILED DESCRIPTION

Figure 1:
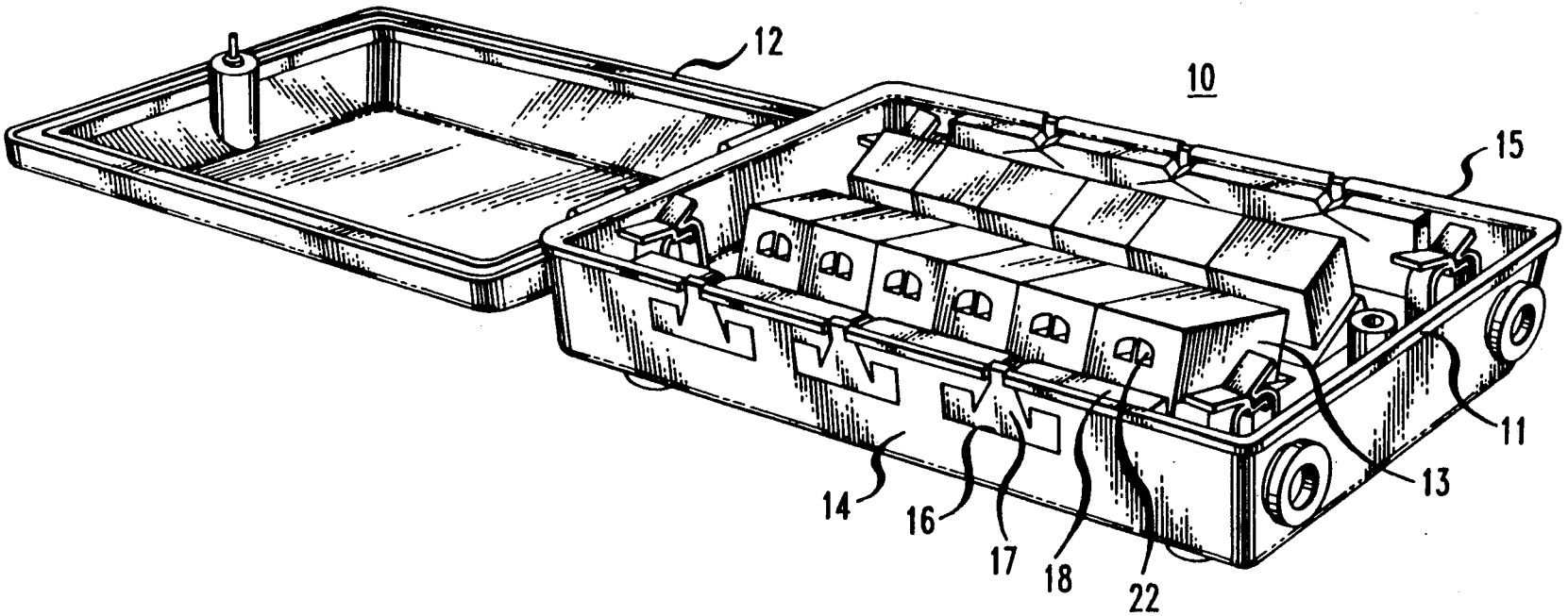
FIG. 1 is a top perspective view of a terminal in accordance with an embodiment of the invention.

As illustrated in FIG. 1, the terminal 10 includes a housing 11 with a base portion and a hinged cover 12. Within the base portion of the housing is a plurality of connector blocks, e.g., 13, which in this example are arranged in two rows of six blocks each. It will be appreciated that the invention is applicable to terminals including any number of connector blocks. Also, the invention would be applicable if means other than connector blocks are used for electrical connection of wires, such as binding posts.

The particular blocks employed in this example have entry ports, e.g., 22, for a pair of wires and means within the block (not shown) for making electrical connections to the wires inserted into the block. Each entry port in a row of blocks faces a corresponding side surface, 14 or 15. Each block is of the type described and claimed in U.S. Pat. No. 4,988,311 issued to Tanzola, which is incorporated by reference herein. Again, the invention is not limited to this particular type of connector block.

Each side surface (e.g., 14) of the housing includes a plurality of apertures (e.g., 16) which permit entry of the wires to be connected to the blocks. In this example, there are three apertures on each side so that each aperture provides entry for two pairs of wires through the side surface of the base portion of the housing. Again, any number of apertures may be employed depending on the number of connector blocks in the housing. Each aperture includes a flexible pad (e.g., 17) therein, which in this example is a closed cell foam pad comprising closed cell cross-linked ethyl vinyl acetate copolymer.

Adjacent to each foam pad within an aperture is a second flexible pad (e.g., 18) of a material which differs from the material of the pad within the aperture. In this example, the second pad (e.g., 18) is also a closed cell foam pad, but comprising closed cell cross-linked polyethylene which is a less stiff material than the pad in the apertures. Conveniently, the second pad (e.g., 18) can be a single pad which is mounted on the inside surface of the side (e.g., 14) of the housing and extends adjacent to all the apertures in that side. Of course, individual pads could also be provided adjacent to each pad within an aperture.

The pads (e.g., 17) within the aperture are typically 2 to 19 mm thick, while the second pads (e.g., 18) are typically, 5 to 25.4 mm thick.

Figure 2:
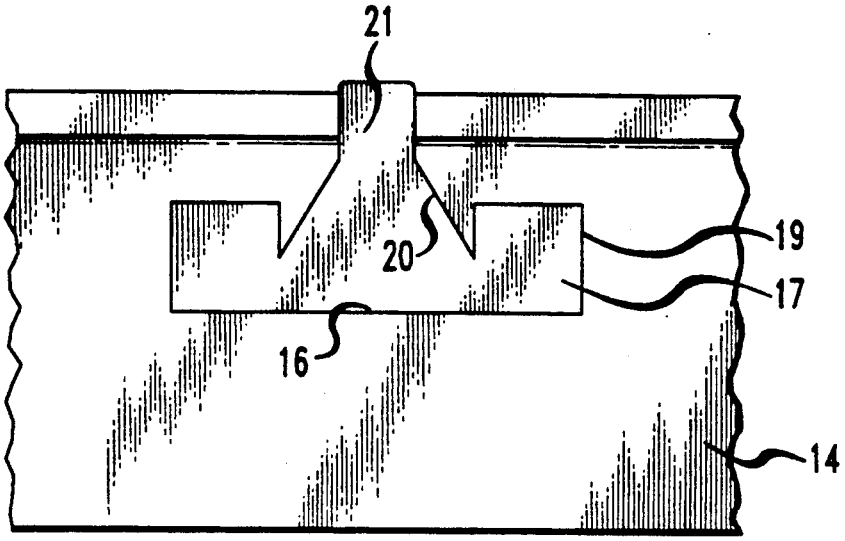
FIGS. 2–3 are enlarged views showing further details of certain portions of the terminal of FIG. 1.

FIG. 2 is an enlarged view of one of the apertures, 16, in the side of the housing. It will be noted that the aperture includes an essentially rectangular base portion 19 which is typically approximately 33 mm wide and 19 mm high. The aperture extends in an essentially inverted V-configuration 20 to an essentially square opening 21 at the top edge of the side 14 of the base portion of the housing. The opening 21 typically measures approximately 5.8 mm wide. The foam pad 17 conforms to the shape of the aperture 16 and extends a small distance above the top edge of the side 14 (typically approximately 0.76 mm).

Figure 3:
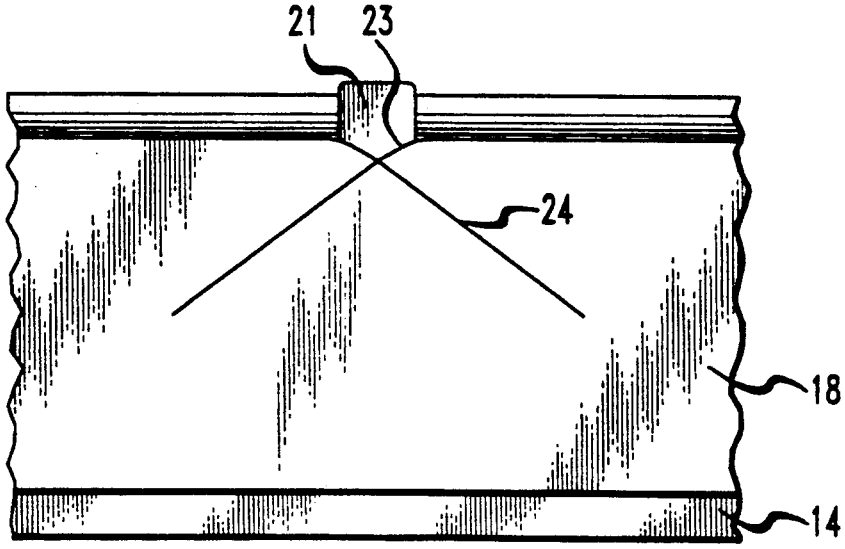

FIG. 3 illustrates the surface of side 14 opposite to that shown in FIG. 2 to reveal further details of pad 18. It will be noted that pad 18 includes a slot 23 at the top and a slit 24 which is in an essentially inverted V-configuration. The slit 24 extends to the slot 23, and the arms of the slit 24 extend into an area adjacent to the base portion of the aperture. In fact, the slit 24 of pad 17 is aligned with the aperture 16 in order to provide a means for entry of wires into the housing (11 of FIG. 1) after electrical connection to a connector block (13 of FIG. 1).

In a typical installation procedure, a first pair of wires (not shown) from outside the terminal would be electrically coupled to an appropriate block (e.g., 13) with the cover (12) of the terminal in an open position. The wire pair would then be inserted through the slit 24 of pad 18 by positioning the wires at the top of the pad 17 and the entrance to the slot 23 and then applying downward pressure. The wires would then be moved to the right or left in the slit 24 in FIG. 3 so that the wires would travel between the pad 17 and the boundary of the aperture 16 in FIG. 2 in the inverted V-portion 20. The wires would then come to rest between the pad 17 and the boundary of the aperture 16 in the base portion 19 of the aperture (i.e., in the upper portion of the base portion). Another wire pair coupled to an adjacent block could then be inserted into slit 24 but moved in the opposite direction so as to be positioned in the opposite side of the aperture base portion. When all electrical connections are made and all wires inserted into the side wall apertures, the cover 12 is closed and installation is completed.

It will be appreciated that the combination of closed cell foam pads, 17 and 18, provides an excellent seal against outside moisture and contaminants. Further, when the wire pairs come to rest, excellent strain relief is provided for the wires by the combination of pads and aperture boundaries exerting pressure on the wires. It will also be appreciated that since pad 17 includes a portion which extends above the top edge of the side surface 14, an enhanced seal is provided between the cover 12 and the side surface.

Various additional modifications will become apparent to those skilled in the art. All such variations which basically rely on the teachings through which the invention has advanced the art are properly considered within the scope of the invention.

We claim:

1. An electrical terminal comprising:

means for providing electrical connections to at least one wire;

a housing for enclosing said connection means, said housing including a side surface with at least one aperture therethrough extending to a top edge of the side surface;

a first flexible pad mounted within the aperture and a second flexible pad mounted adjacent to the first pad and said second pad having a slit extending to a top surface of the second pad so that the first pad covers the slit and the slit is capable of receiving a wire therein inserted from the top surfaces of the pads.

2. The terminal according to claim 1 wherein the side surface is part of a base portion of the housing which further includes a cover positioned on the top edge of the side surface when closed.

3. The terminal according to claim 1 wherein the slit is formed in an inverse V-configuration extending to the top surface of the pad.

4. The terminal according to claim 3 wherein the aperture includes an essentially rectangular base portion where the wire comes to rest after insertion, an inverse V-configuration portion, and a portion at the top edge of the side surface.

5. The terminal according to claim 1 wherein one of said pads comprises a stiffer material than the other of said pads.

6. The terminal according to claim 1 wherein each pad comprises a closed cell foam.

7. The terminal according to claim 6 wherein the first pad comprises closed cell cross-linked ethyl vinyl acetate copolymer and the second pad comprises closed cell cross-linked polyethylene.

8. The terminal according to claim 2 wherein the first pad extends above the top edge of the side surface to enhance the seal between the cover and side surface.

9. The terminal according to claim 1 wherein the thickness of the first pad is within the range 2 to 19 mm and the thickness of the second pad is within the range 5 to 25.4 mm.

10. The terminal according to claim 1 further comprising a second side surface which also includes one aperture therethrough.

11. The terminal according to claim 1 wherein the second pad includes a slot at the top edge of the pad.

* * * * *